US008112912B2

(12) United States Patent
Doan

(10) Patent No.: US 8,112,912 B2
(45) Date of Patent: Feb. 14, 2012

(54) DUMP BLOCK WITH IMPROVED ASSEMBLY FEATURES

(75) Inventor: Stephen P. Doan, Oregon City, OR (US)

(73) Assignee: Columbia Steel Casting Co., Inc., Portland, OR (US)

( * ) Notice: Subject to any disclaimer, the term of this patent is extended or adjusted under 35 U.S.C. 154(b) by 119 days.

(21) Appl. No.: 12/564,888

(22) Filed: Sep. 22, 2009

(65) Prior Publication Data

US 2011/0067275 A1 Mar. 24, 2011

(51) Int. Cl.
*E02F 3/60* (2006.01)

(52) U.S. Cl. ..... 37/399; 37/394; 37/398; 294/68.26; 294/68.27

(58) Field of Classification Search ..... 37/399, 37/394–398, 182, 461; 294/68.2, 68.26, 294/68.27
See application file for complete search history.

(56) References Cited

U.S. PATENT DOCUMENTS 1,732,942 A * 10/1929 Martinson et al. ..... 188/64
2,034,728 A * 3/1936 Nichols ..... 254/401
2,288,116 A * 6/1942 Stillwagon ..... 254/405
2,459,290 A * 1/1949 Rozner ..... 254/404
2,650,403 A * 9/1953 Taylor, Jr. et al. ..... 294/82.2
2,859,075 A * 11/1958 Hobbs et al. ..... 384/477
4,492,416 A * 1/1985 Kaufmann ..... 384/474
4,640,496 A * 2/1987 Van Hoomissen et al. ... 254/415
5,321,902 A * 6/1994 Gregory ..... 37/397
5,398,433 A * 3/1995 Dretzka ..... 37/399
5,590,968 A * 1/1997 Dretzka ..... 384/563
5,636,460 A * 6/1997 Dretzka ..... 37/397
5,956,936 A 9/1999 Ianello et al.
5,970,636 A * 10/1999 Briscoe et al. ..... 37/396
6,041,476 A * 3/2000 deNormand ..... 16/197
6,170,248 B1 1/2001 Ianello et al.
6,871,486 B2 3/2005 Moehnke et al.
7,255,330 B2 * 8/2007 Lutter et al. ..... 254/393
7,431,269 B2 * 10/2008 Carlson et al. ..... 254/405
7,614,611 B1 * 11/2009 Walton et al. ..... 254/393

* cited by examiner

*Primary Examiner* — Thomas Beach
*Assistant Examiner* — Matthew Buck
(74) *Attorney, Agent, or Firm* — Klarquist Sparkman, LLP

(57) ABSTRACT

A dump block with a self-adjusting bearing includes two side sections, a sheave with a peripheral groove and a central bore, a bearing assembly, and a sheave pin. The sheave pin has a first end with a shoulder, a second end with a threaded portion, and a bearing support section of a predetermined length extending between the first and second ends. The sheave pin is positioned within the bearing assembly and adjusted by urging the sheave pin to translate in the direction of the second end. A fastener is secured to the threaded section at a location between the two side sections.

11 Claims, 7 Drawing Sheets

DUMP BLOCK WITH IMPROVED ASSEMBLY FEATURES

FIELD

The present disclosure relates to equipment for use in excavation or mining processes, and dump blocks in particular.

BACKGROUND

Dragline excavation systems comprise heavy equipment that can remove materials from the ground, such as overburden, in surface mining or other civil engineering projects where large volumes of material must be removed in an efficient manner. A typical dragline excavation system includes a large bucket that is suspended from a boom (a large truss-like structure) with wire ropes. The bucket is maneuvered by means of a number of ropes and chains. The hoist rope, typically powered by large diesel or electric motors, supports the bucket and hoist-coupler assembly from the boom. The dragline is used to draw the bucket assembly horizontally to scoop up and remove material from the ground. By skillful maneuver of the hoist and the dragline, the bucket can be controlled for various operations.

Dragline excavation systems provide several advantageous features over other earthmoving equipment, including a long reach for both digging and dumping, the ability to dig below their tracks (or base), and a high cycle speed. However, the loads and stresses applied to the various parts of the dragline excavation system are massive and the parts associated with the system must be able to withstand such stresses. In addition, the harsh environment in which a dragline excavation system operates can further contribute to increased wear of the various parts of the dragline excavation system. Because of the tremendous size and weight of the various parts of these systems, failure of a single part can result in significant downtime.

SUMMARY

In a first embodiment, a dump block comprises a housing with two side sections, a sheave, a bearing assembly, and a sheave pin. Each side section has an opening extending therethrough. The sheave has a peripheral groove shaped to receive a rope and a central bore. The bearing assembly is positioned within the central bore. The sheave pin rotatably supports the sheave. The sheave pin has a first end with a shoulder portion, a second end with a threaded portion, a support section of a predetermined length extending between the first and second ends, and a fastener coupleable to the second end at the threaded portion. When the sheave pin is assembled with the housing, the first and second ends of the sheave pin extend into the respective openings in the side sections. The bearing assembly is installed within the sheave and adjusted by urging the sheave pin to translate in the direction of the second end and securing the fastener to the threaded section at a location between the two side sections.

In one specific implementation, the housing comprises substantially solid side sections. In another specific implementation, the fastener is secured to the threaded section with a force sufficient to cause the shoulder portion to bear against the bearing assembly until the predetermined length of the support section is fully seated. In another specific implementation, the portions of the first and second ends that extend through the respective openings in the side sections each comprise an extending threaded portion, and a securing mechanism is coupled to each extending threaded portion to secure the sheave pin to the two side sections.

In another specific implementation, the bearing assembly comprises an outer surface and the sheave comprises an inner surface that defines the central bore, and the outside surface of the bearing assembly is secured to the inner surface of the sheave with an interference fit. In another specific implementation, the inner surface of the sheave comprises first and second indentations to facilitate positioning of the bearing assembly within the central bore, and a first ring is positioned within the first indentation and a second ring is positioned within the second indentation, and at least a portion of the bearing assembly is positioned between the first and second rings.

In another specific implementation, the bearing assembly comprises an open-ended cylindrical member with two tapered cone members positioned within the cylindrical member and spaced apart by at least one spacer member. In another specific implementation, the first end further comprises a lubrication port in fluid communication with a lumen that extends at least partially through the sheave pin for delivering lubrication to the bearing assembly.

In another embodiment, a dump block includes a housing comprising two side sections, a sheave, a bearing assembly, and a shaft. Each side section comprising an opening extending therethrough and the sheave has a peripheral groove shaped to receive a rope. The sheave has a central bore and the bearing assembly is positioned within the central bore. The shaft rotatably supports the sheave and has an asymmetrical configuration dimensioned to positively locate the shaft pin within the bearing assembly.

In one specific implementation, when the shaft is assembled with the housing, the first and second ends of the shaft extend into the respective openings in the side sections. In another specific implementation, the shaft comprises a first end with a shoulder portion sized to contact the bearing assembly and a second end with a threaded portion sized to receive a fastener, and the position of the shaft relative to the bearing assembly can be adjusted by applying a torque to the fastener. In another specific implementation, the bearing assembly is substantially sealed after installation in the dump block.

In another embodiment, a method of assembling a dump block is provided. The method comprises: providing a sheave with a peripheral groove and having a central bore; providing a bearing assembly; and providing a sheave pin with a first end that with a shoulder portion, a second end with a threaded portion, and a support section between the first and second ends. The method comprises positioning the bearing assembly within the central bore; inserting the second end of the sheave pin into the bearing assembly and securing a fastener to the second end of the sheave pin; and adjusting the position of the sheave pin relative to the bearing assembly by causing the shoulder portion to bear against the bearing assembly until the support section is fully seated. The method further comprises providing a first side section and a second side section; and securing the first and second side section to the sheave pin.

In one specific implementation, the act of positioning the bearing assembly within the central bore comprises heating the sheave and positioning the bearing assembly within the heated sheave. In another specific implementation, the act of positioning the bearing assembly within the central bore comprises positioning at least one ring in at least one indentation in an inner surface of the central bore; and positioning the bearing assembly adjacent to the at least one ring.

In another specific implementation, the act of securing the first and second side sections comprises providing two fasteners, securing one of the two fasteners to a portion of the first end that extends out of an opening in the side of the first side section, and securing the other of the two fasteners to a portion of the second end that extends out of an opening in the side of the second side section.

In another specific implementation, the method further comprises securing the first and second side sections to one another at locations radially outside of the location of the sheave. In another specific implementation, the method further comprises lubricating the bearing assembly by delivering lubricant through a port located at the first end of the sheave pin, with the port being in fluid communication with a lumen that extends at least partially through the sheave pin.

The foregoing and other objects, features, and advantages of the embodiments disclosed herein will become more apparent from the following detailed description, which proceeds with reference to the accompanying figures.

DETAILED DESCRIPTION

The following detailed description includes references to the accompanying drawings, which form a part of the detailed description. The drawings show, by way of illustration, example embodiments in which the subject matter may be practiced. These embodiments, which are also referred to herein as "examples," are described in enough detail to enable those skilled in the art to practice the subject matter. The embodiments may be combined, other embodiments may be used, or structural and other changes may be made without departing from the scope of the present subject matter. The following detailed description is, therefore, not to be taken in a limiting sense, and the scope of the present subject matter is defined by the appended claims and their equivalents.

As used in this application and in the claims, the singular forms "a," "an," and "the" include the plural forms unless the context clearly dictates otherwise. Additionally, the term "includes" means "comprises." Further, the terms "coupled" and "secured" generally mean electrically, electromagnetically, and/or physically (e.g., mechanically or chemically) coupled or linked and does not exclude the presence of intermediate elements between the coupled or secured items absent specific contrary language.

Although the operations of exemplary embodiments of the disclosed method may be described in a particular, sequential order for convenient presentation, it should be understood that disclosed embodiments can encompass an order of operations other than the particular, sequential order disclosed. For example, operations described sequentially may in some cases be rearranged or performed concurrently. Further, descriptions and disclosures provided in association with one particular embodiment are not limited to that embodiment, and may be applied to any embodiment disclosed.

Figure 1:
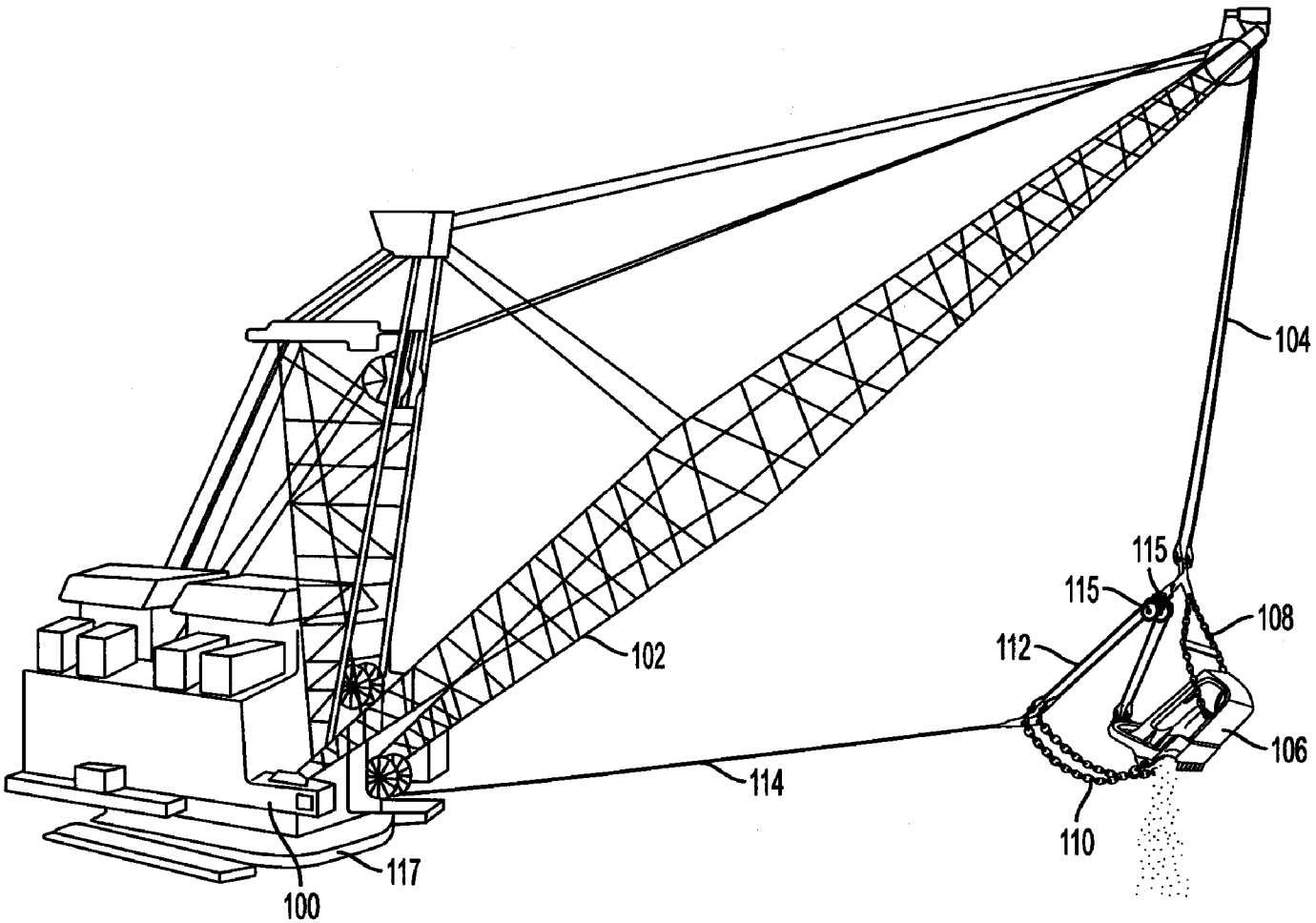
FIG. 1 illustrates a dragline excavation system with a dump bucket.

Referring to FIG. 1, the major components of a dragline excavation system 10 include a powerplant 100, a boom 102, a hoist cable 104, a bucket 106, hoist chains 108, drag chains 110, dump cables 112, drag cables 114, and respective dump blocks 115. Powerplant 100 can be mounted on a rotary base 117, allowing the boom to swing in the horizontal plane. Smaller draglines typically employ sets of tracks for moving the machine, while larger draglines use a "walking" mechanism. These larger machines are typically referred to as walking draglines. Hoist cable 104 can be retracted or extended by means of a hoist drum (not shown) that is located in the powerplant. Likewise, drag cable 114 can be retracted and extended by means of a drag drum (not shown) located in the powerplant.

Figure 2:
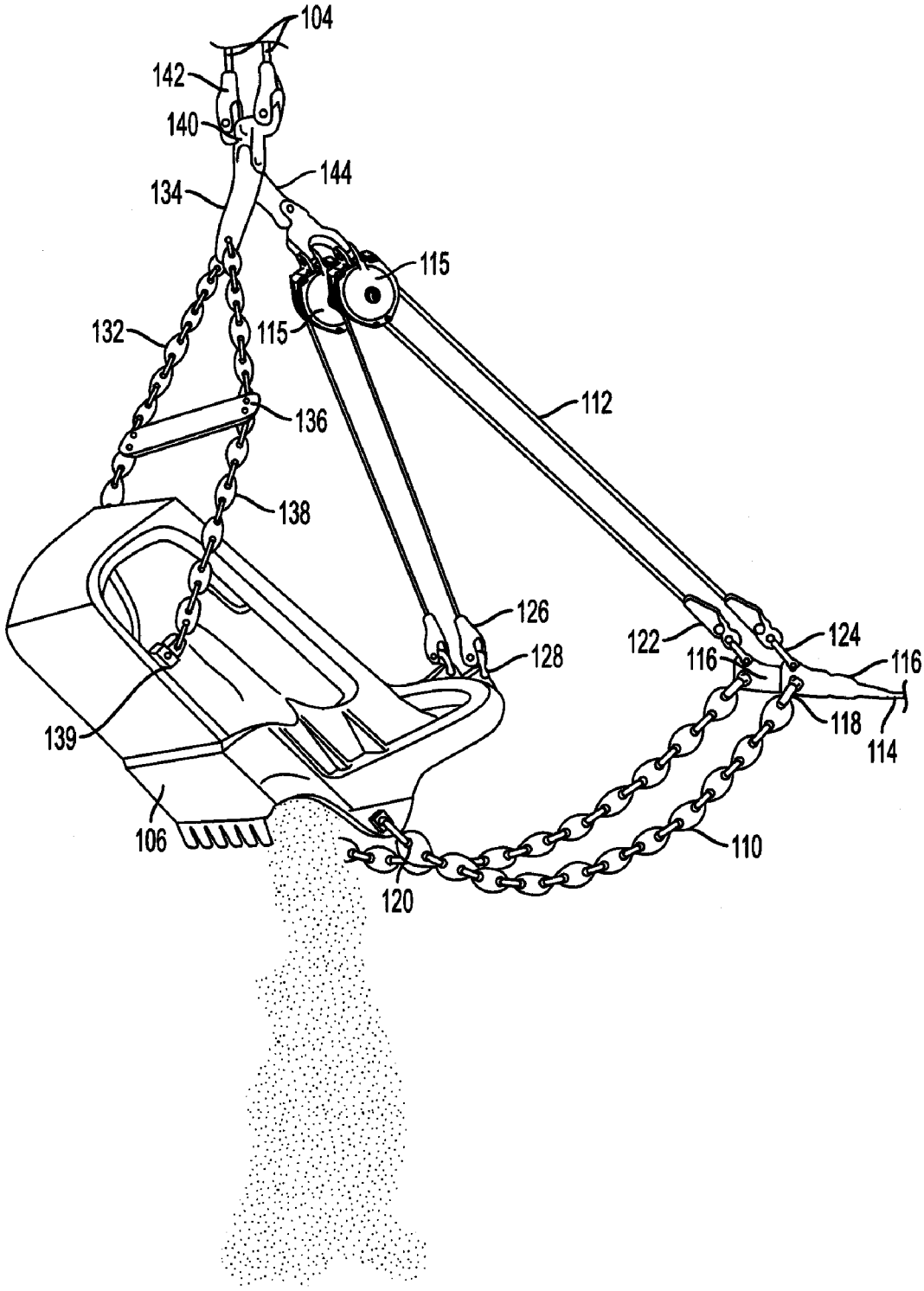
FIG. 2 illustrates an enlarged view of a portion of the dragline excavation system, showing the use of two dump blocks.

As shown in FIG. 2, drag cable 114 can be connected to a pair of drag sockets 116. Drag sockets 116 can be connected through drag devises 118 to the drag chains 110. Drag chains 110 can be connected to the bucket 106 at hitch devises 120. Drag sockets 116 can also be respectively connected to a pair of dump sockets 122 at dump devises 124. A second pair of dump sockets 126 can be connected to the front of bucket 106 at anchor links 128. The dump sockets 122 and 126 are commonly connected to a respective pair of dump cables 112, which ride on one or more sheaves of dump blocks 115. Although the system 10 of FIG. 1 illustrates the use of two dump blocks 115, it should be understood that fewer (i.e., one dump block) or more dump blocks can be used. As discussed in more detail below, dump block 115 is a pulley-like device that functions to change the direction of forces exerted on bucket 106 so that bucket 106 can be filled and emptied.

A pair of upper hoist chains 132 are commonly connected to the bottom of a pickup link 134 at their top ends, and to opposing sides of a spreader 136 at their bottom ends. A pair of lower hoist chains 138 are connected to the spreader 136 at their top ends, and are connected at their bottom ends to the bucket 106 at trunnions 139. The pickup link 134 is connected to a hoist equalizer 140, which in turn is connected to hoist sockets 142. Hoist sockets 142 can be connected to the hoist cables 104. Hoist equalizer 140 can also be connected to a pickup link 144, which is connected to the dump block 115.

The loads on the hoist and drag chain links are massive. It is common for the largest draglines to employ hoist and drag cables or ropes that are 5 inches in diameter. These cables are typically made out of very high strength steels, and can support suspended loads of upwards of 750,000 lbs. The loads placed on the hoist chains and drag chains are equally impressive. These loads dictate the use of specialized chain links made from ultra-high-strength alloyed steels. In addition, these chains and chain links are preferably designed to endure a tremendous amount of wear.

Figure 3A:
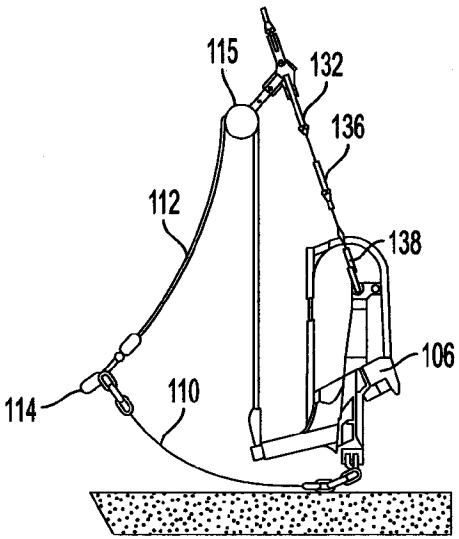
FIGS. 3A-3F illustrate enlarged views of a portion of a dragline excavation system as the system is operated to scoop up material from a surface.
Figure 3B:
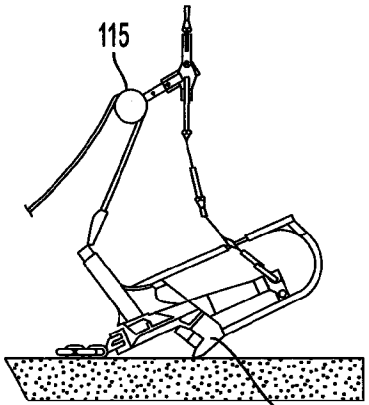
Figure 3C:
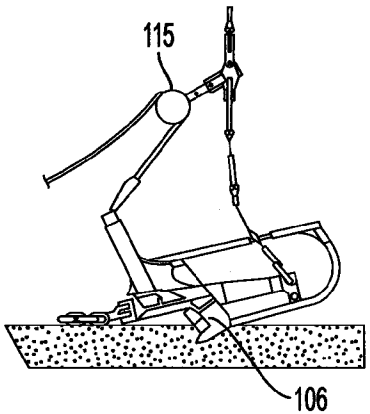
Figure 3D:
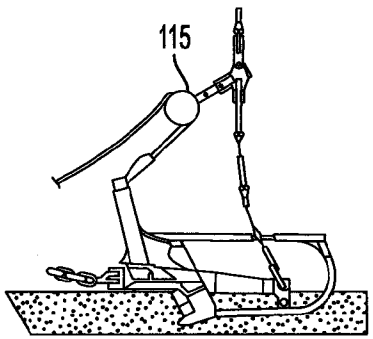
Figure 3E:
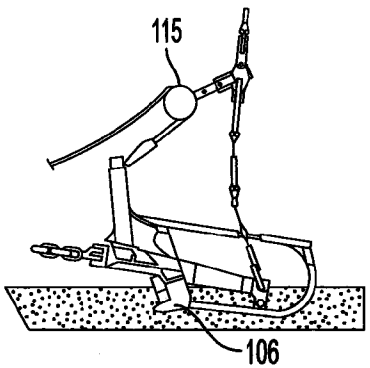
Figure 3F:
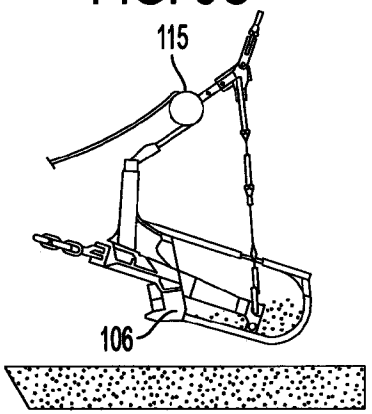

A typical dragline digging cycle is shown in FIGS. 3A-3F. As shown in FIG. 3A, the digging cycle begins by lowering the bucket into the mine pit (or other suitable location) with both the hoist cable 132 and the drag cable 114 nearly taut until the bucket contacts the pit surface. At this point, hoist cable 132 is slightly slackened and drag cable 114 is pulled towards powerplant 100. FIGS. 3B-3E illustrate how bucket 106 scoops up material from the surface of the mine pit while it is dragged towards across the surface towards powerplant 100. The movement of bucket 106 causes the bucket teeth to dig into the surface of the ground, cutting into the ground surface, and forcing material to pile up inside bucket 106 as the bucket moves horizontally. The depth and angle of the cut may be controlled by varying the hoist cable length as the drag cable is pulled.

Once bucket 106 is filled or otherwise moved through the desired surface area, the orientation of bucket 106 can be adjusted so that at least a substantial portion of the material will remain in bucket 106 while it is transported (generally via a swing operation) to a different location for dumping. At the dumping location, drag cable 114 can be slackened (e.g., released) while hoist cable 104 is held taut, causing bucket 106 to tilt and empty (as shown in FIG. 1).

During the dragging and dumping operations, dump block 115 desirably allows for the smooth transition of forces between the hoist cables and drag cables. Like the other parts of the excavation dragline system, however, dump blocks are subjected to high forces, stresses, and harsh conditions. In addition, because dump blocks 115 contain moving parts (e.g., a rotatable sheave as discussed in more detail below), dump blocks 115 can be particularly susceptible to failure or malfunction.

Referring to FIGS. 4-7, dump block 115 comprises a sheave (pulley) 150 that is rotatably mounted around a shaft (e.g., sheave pin) 151. Shaft 151 defines an axis of rotation about which sheave 150 rotates. Sheave 150 comprises a wheel or roller with a peripheral grooved section 153 for receiving or holding a rope, and a central bore 158 for receiving a bearing assembly. As used herein, rope generally refers to any elongate flexible material suitable for use with a dump block operation, including, for example, wires, cables, chains, and other braided fibers or materials.

A first side frame 152 and a second side frame 154 collectively define a housing that at least partially encloses the sides of sheave 150. Preferably, first and second side frames 152, 154 are substantially solid sections that restrict contaminants from entering the housing and causing damage to the internal structure of the dump block. Shaft 151 is positioned within a bearing assembly 156, which in turn is positioned within central bore (aperture/opening) 158 of sheave 150. To facilitate smooth operation of the sheave 150, bore 158 is preferably located at a substantially central location with respect to a diameter of sheave 150.

Bore 158 is preferably sized to receive the bearing assembly 156 with an interference fit. If desired, during dump block assembly, sheave 150 can be heated to slightly enlarge bore 158 to facilitate the receipt of bearing assembly 156 within bore 158. Thus, the temperature of sheave 150 can be increased causing bore 158 to expand slightly, bearing assembly 156 can be inserted into bore 158, and, as sheave 150 cools, bore 158 will decrease slightly in size causing an interference fit between an inner surface of sheave 150 (which defines bore 158) and an outer surface of bearing assembly 156.

Figure 8:
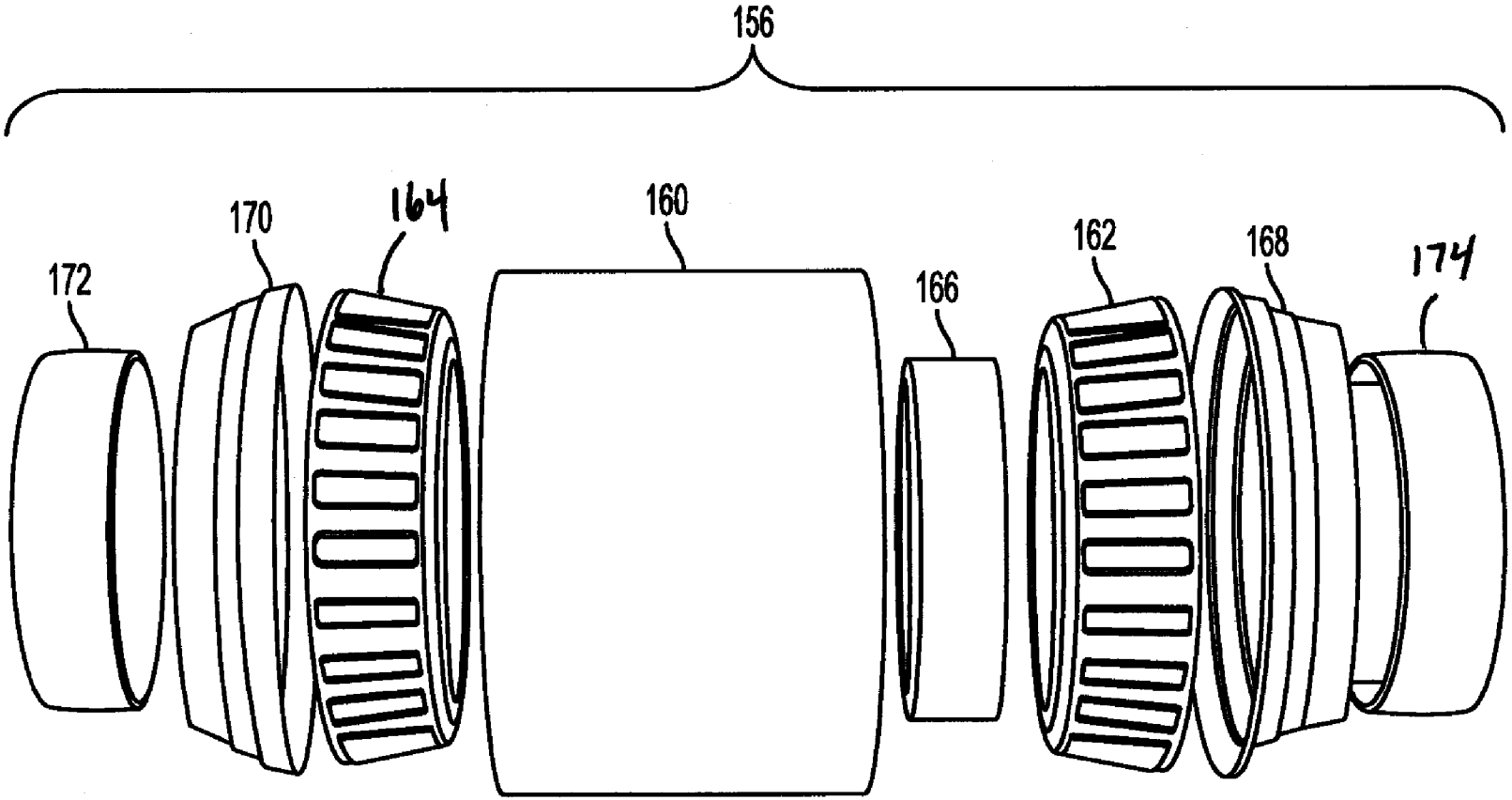
FIG. 8 is an exploded side view of a bearing assembly.

Bearing assembly 156 is preferably a bearing assembly that does not require adjustment at installation (i.e., a self-adjusting bearing). FIG. 8 illustrates a bearing assembly 156 that comprises a cup member 160 (e.g., an open-ended cylindrical member), a first cone member 162, and a second cone member 164. A cone spacer 166 can be positioned between the first and second cone members 162, 164. As shown in FIG. 8, seals 168, 170 can be provided adjacent to the cone members 162, 164 (respectively) to maintain the lubrication of bearing assembly 156. In addition, seal wear rings 172, 174 can be positioned adjacent the seals 168, 170, as shown in FIG. 8. A bearing assembly as described in FIG. 8 can be obtained from the Timken Company, which provides so-called "AP Bearings for Industrial Applications."

Figure 9:
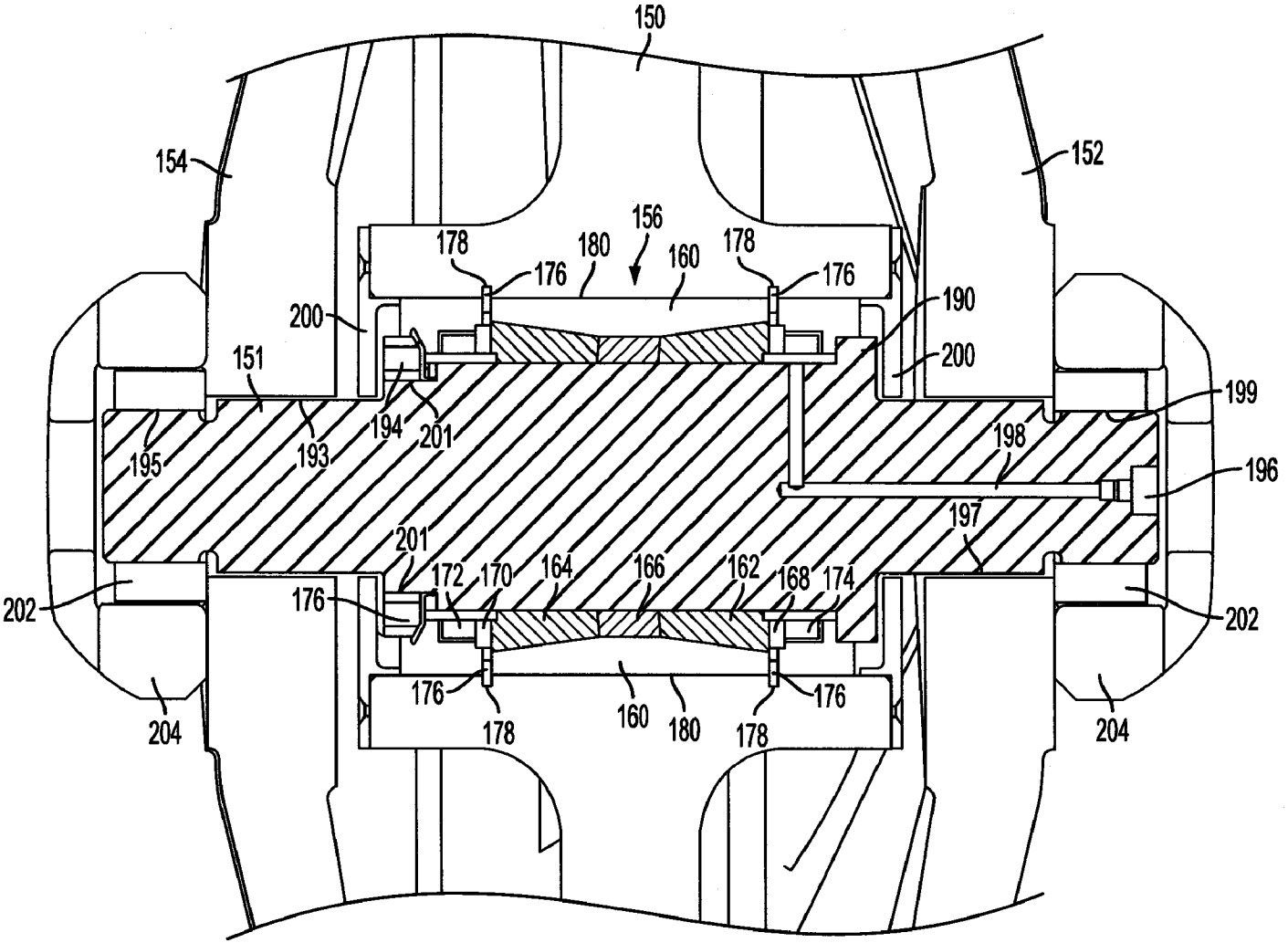
FIG. 9 is an enlarged, side cross-sectional view of a portion of the dump block of FIG. 4.

Referring to FIG. 9, the assembly of dump block 115 is described in more detail. Bearing assembly 156 (comprising cup member 160, cones 162, 164, cone spacer 166, seals 168, 170, and seal rings 172, 174) is shown positioned within bore 158. Bore 158 is defined by an inner surface 180 of the sheave 150. As discussed above, inner surface 180 and an outer surface of the bearing assembly 156 (i.e., the outer surface of cup member 160) preferably form an interference fit to secure the two surfaces together. In order to facilitate positioning of the bearing assembly 156, snap rings 176 can be positioned on either side of cup member 160 and received into indentations 178 in surface 180. One or both of rings 176 can be used to guide or otherwise facilitate positioning of the bearing assembly 156 within bore 158.

After bearing assembly 156 is secured to sheave 150, shaft 151 can be inserted through bearing assembly 156 to occupy the assembled position as shown in FIG. 9. Shaft 151 preferably has a first support end that has a shoulder portion (e.g., a radially enlarged section) 190, a support second end with a threaded portion 201, and a support section 191 between the first and second support ends. Thus, shaft 151 is configured to be inserted through bearing assembly 156 in only one direction (i.e., from right to left as viewed in FIG. 9, before the side plates 152, 154 and fastener 194 are installed). The threaded portion 201 of the second support end can be configured to receive a fastener or other securing mechanism. The fastener is preferably received on the shaft at a location that is between first and second side frames 152, 154 (e.g., within the housing). For example, a washer 192 and fastener (locknut) 194 combination can be secured to shaft 151 within the housing as shown in FIG. 9.

Bearing assembly 156 can be assembled and adjusted by urging shaft 151 to translate in the direction of the second support end. Thus, bearing assembly 156 can be fully adjusted by securing the fastener 194 to threaded portion 201 and providing a force sufficient to cause the shoulder portion 190 to bear against bearing assembly 156 until the predetermined length of support section 191 is fully seated.

The second end of shaft 151 can comprise an extending section 193 configured to extend through an opening in second side frame 154 and an extending threaded portion 195. The extending threaded portion 195 extends outside of second side frame 154 and a securing mechanism (e.g., nut 202 as discussed below) can secure extending threaded portion 195 to second side frame 154. Thus, second end of shaft 151 comprises threaded portion 201, extending section 193, and extending threaded portion 195.

First end of shaft 151 can further comprise an extending section 197 that extends beyond the shoulder portion 190 (i.e., further from the second end). Extending section 197 can be a section with a smaller diameter than shoulder portion 190 and can extend through an opening in first side frame 152, as shown in FIG. 9. A further extending section can comprise a threaded portion 199 that is configured to receive a securing mechanism (e.g., nut 202 as discussed below) to secure threaded portion 199 to the first side frame 152. Thus, first end of shaft 151 comprises shoulder portion 190, extending section 197, and threaded portion 199.

Figures 4, 5, 6, 7:
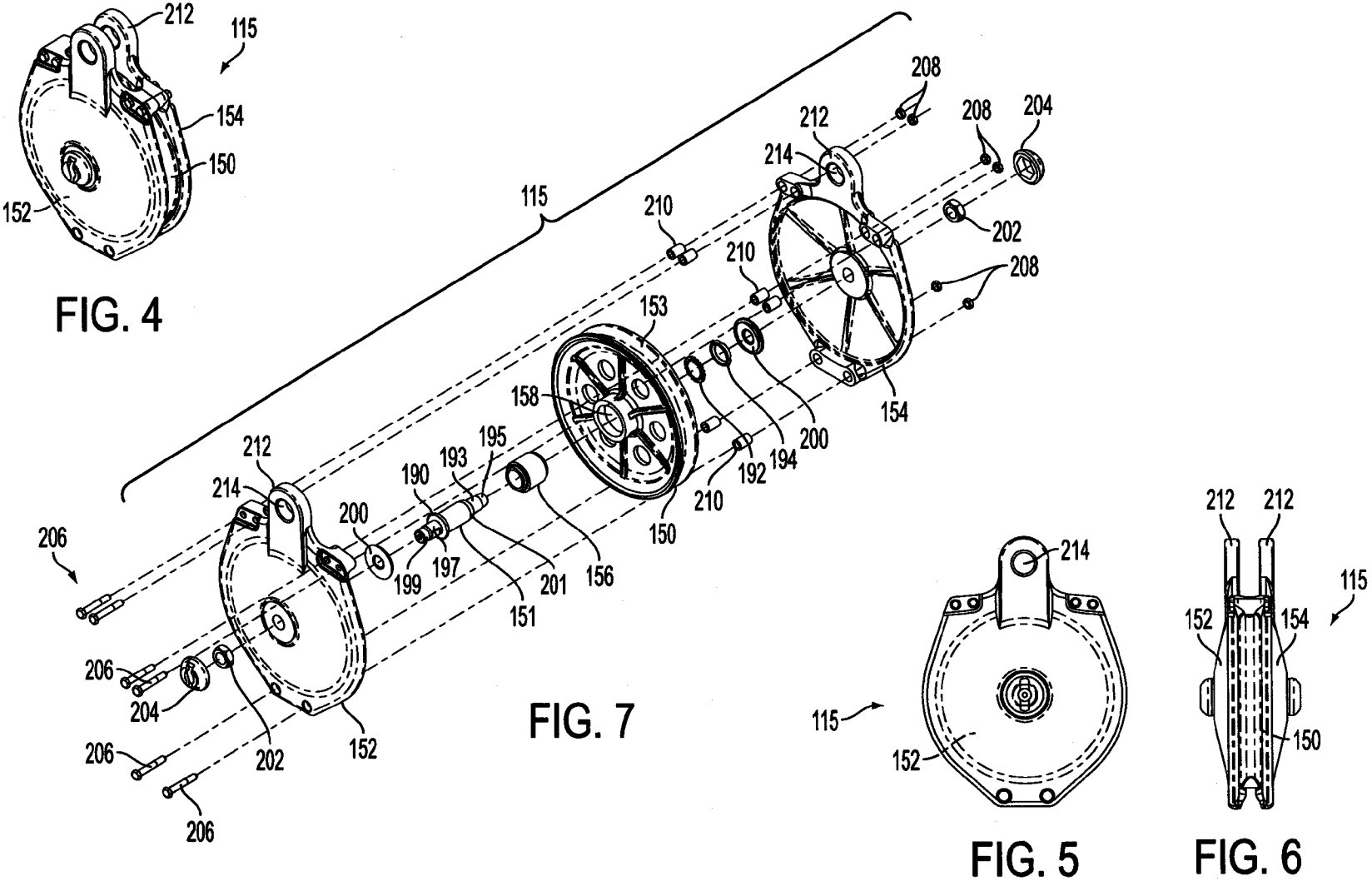
FIG. 4 is a front isometric view of a dump block.
FIG. 5 is a front view of the dump block of FIG. 4.
FIG. 6 is a side view of the dump block of FIG. 4.
FIG. 7 is an exploded isometric view of the dump block of FIG. 4.

As shown in FIG. 9, a lubricant entry area (port) 196 and a lubricant pathway (lumen) 198 through shaft 151 can be provided to deliver grease or other lubrication to bearing assembly 156. Dust caps 200 can optionally be used to cover the shoulder portion 190 and the washer/locknut 192, 194 combination as shown in FIGS. 7 and 9. Bearing assembly 156 is preferably prefilled (i.e., factory filled) with lubricant. If desired, however, additional lubricant can be added to completely fill the bearing assembly during assembly to help prevent contamination of the bearing assembly. Preferably, sufficient lubrication is used so that further lubrication is not required over the life of the dump block assembly.

After bearing assembly 156 is positioned within bore 158, and shaft 151 is positioned and secured to bearing assembly 156 (as discussed above), first side frame 152 and second side frame 154 can be secured to shaft 151. To secure first side frame 152 and second side frame 154 to shaft 151, nuts 202 (or other fasteners) can be screwed onto the respective threaded portions 195, 199 that extend out of the openings in the first and second side frames 152, 154 (as shown in FIG. 9). If desired, nut locks 204 can be secured to nuts 202 to further secure first and second side members 152, 154 to each other (through shaft 151). Nut locks 204 can optionally be welded in place.

First and second side frames 152, 154 can be additionally secured to one another by using fasteners, such as bolts 206 and nuts 208 as shown in FIG. 7. Bolts 206 and nuts 208 are preferably received in recesses in first and second side frames 152, 154 to protect them from exposure or impact with the outside environment during use of the dump block. If desired, sleeves 210 can be positioned within the opening for receiving bolts 206. Sleeves 210 can be constructed of rubber or other similar resilient materials.

It should be understood that the order in which the various parts of the dump block are installed can vary. For example, it can be preferable to insert the shaft into the bearing assembly before inserting the bearing assembly into the bore. Thus, the assembly of the various parts of the dump block can be achieved using the same steps described above but performed in a different order. Such variations fall within the scope of the disclosed embodiments.

Figure 10:
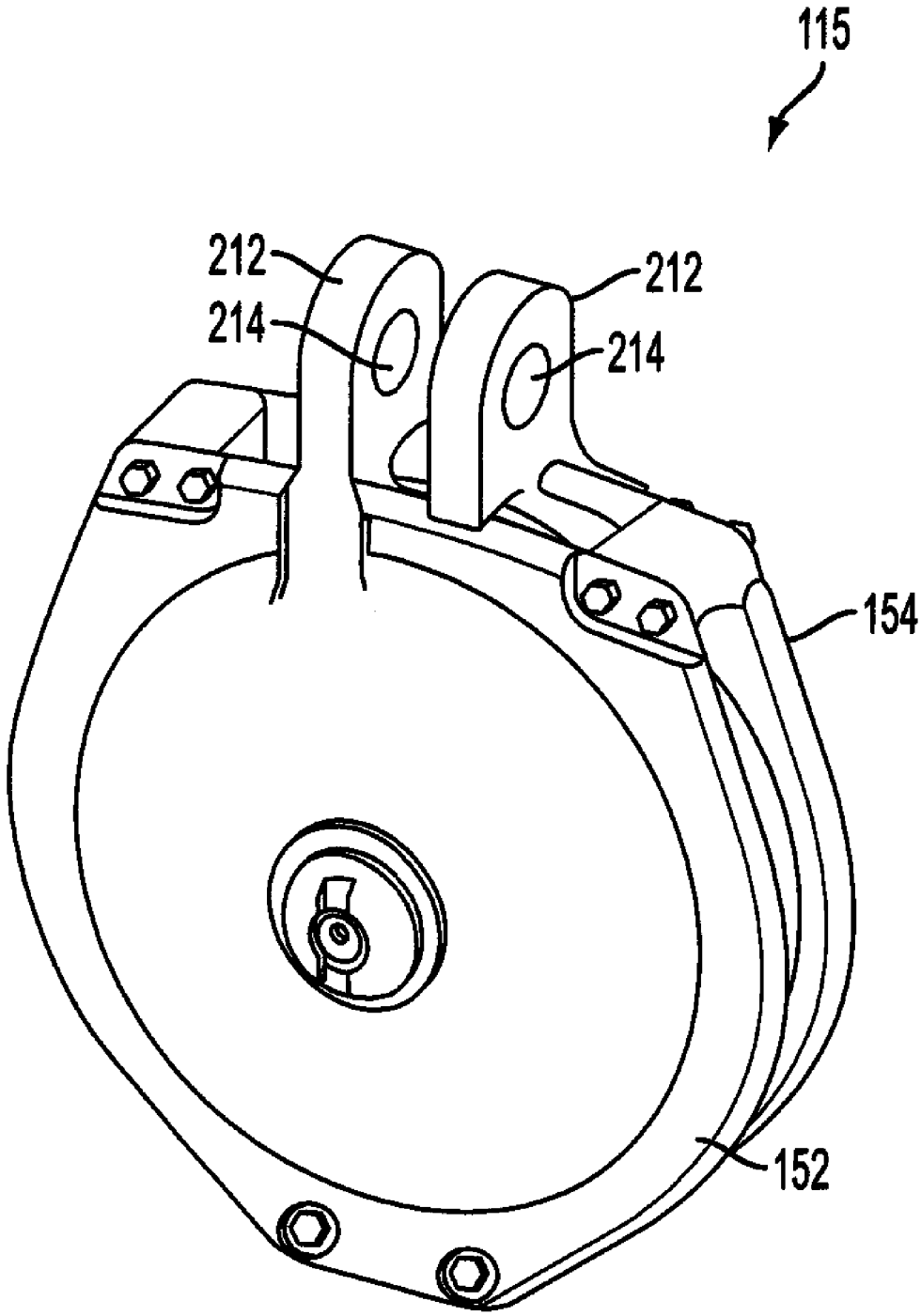
FIG. 10 is a front isometric view of a dump block with opposite-plane extension members.

As shown in FIG. 4, for example, dump block 115 can comprise one or more extensions 212 that are configured with apertures 214 to receive pins (not shown) to couple dump block 115 to hoist cables 104 (either directly or indirectly). In FIG. 4, extensions 212 are shown as being in the same general plane as the first and second side frames 152, 154; however, it should be understood that other configurations can be used. For example, FIG. 10 illustrates a dump block 115 that has extensions 212 that are configured out-of-plane (e.g., perpendicular) relative to a plane of the first and second side frame members 152, 154.

Preferably, the tolerances between the sheave and extensions are sufficient to permit rope for a ferrule socket to pass through the dump block while the dump block is assembled. Thus, a ferrule socket (or becket end) of a rope can pass through the dump block when changing or adding a rope system without any disassembly or alteration of the dump block.

The bearing assemblies described herein provide for more efficient and more accurate assembly and rebuilds of dump blocks. For example, when using conventional bearing assemblies with a dump block, significant adjustment is required during assembly and rebuilding. Fasteners must be carefully adjusted at both ends of the bearing assembly in order to ensure that the shaft and bearing assembly are appropriately centered during assembly to achieve the desired amount of end-to-end movement (i.e., "end play") of the shaft. Generally, this means that the end fasteners must be repeatedly adjusted, which may require repeated assembly and disassembly of the side plates, until the bearing assembly and shaft are correctly positioned. Such careful adjustment is necessary both during initial assembly and during any necessary rebuilds during the life of the dump block.

In contrast, the bearing assemblies of the dump block configurations disclosed herein are substantially self-centering. By providing a shaft with a positive positioning feature, such as a shoulder portion as described above, the shaft and bearing assembly can be assembled (or rebuilt) quickly and with little, if any, adjustment to align the shaft and the bearing assembly. In addition, the bearing cavity is substantially protected from material intrusion due to its enclosed design. Conventional bearing assemblies often require o-rings to facilitate sealing the assembly from the environment. However, o-ring seals are often susceptible to failure. The use of bearing assemblies as disclosed herein can eliminate the need for an o-ring, thereby providing a better sealing environment.

In addition, because the sides of the housing are substantially solid, the internal portions of the housing are further protected from rough service environments, which can further increase service life of the dump block.

In view of the many possible embodiments to which the disclosed principles may be applied, it should be recognized that the illustrated embodiments are only preferred examples and should not be taken as limiting in scope. Rather, the scope of protection is defined by the following claims. We therefore claim all that comes within the scope and spirit of these claims.

I claim:

1. A dump block, comprising:

a housing comprising two side sections, each side section comprising an opening extending therethrough;

a sheave with a peripheral groove shaped to receive a rope, the sheave having a central bore;

a bearing assembly positioned within the central bore; and a sheave pin that supports the sheave, the sheave pin having a first end with a shoulder portion, a second end with a threaded portion, a support section of a predetermined length extending between the first and second ends, and a fastener coupleable to the second end at the threaded portion, wherein when the sheave pin is assembled with the housing, the first and second ends of the sheave pin extend into the respective openings in the side sections, wherein the bearing assembly is installed within the sheave and adjusted by urging the sheave pin to translate in the direction of the second end and securing the fastener to the threaded section at a location between the two side sections, wherein the bearing assembly comprises an outer surface and the sheave comprises an inner surface that defines the central bore, and the outside surface of the bearing assembly is secured to the inner surface of the sheave with an interference fit, and wherein the inner surface of the sheave comprises first and second indentations to facilitate positioning of the bearing assembly within the central bore, and a first ring is positioned within the first indentation and a second ring is positioned within the second indentation, and at least a portion of the bearing assembly is positioned between the first and second rings.

2. The dump block of claim 1, wherein the housing comprises substantially solid side sections.

3. The dump block of claim 1, wherein the fastener is secured to the threaded section with a force sufficient to cause the shoulder portion to bear against the bearing assembly until the predetermined length of the support section is fully seated.

4. The dump block of claim 1, wherein the portions of the first and second ends that extend through the respective openings in the side sections each comprise an extending threaded portion, and a securing mechanism is coupled to each extending threaded portion to secure the sheave pin to the two side sections.

5. The dump block of claim 1, the bearing assembly comprises an open-ended cylindrical member with two tapered cone members positioned within the cylindrical member and spaced apart by at least one spacer member.

6. The dump block of claim 1, wherein the first end further comprises a lubrication port in fluid communication with a lumen that extends at least partially through the sheave pin for delivering lubrication to the bearing assembly.

7. A method of assembling a dump block, comprising:

providing a sheave with a peripheral groove and having a central bore;

providing a bearing assembly;

providing a sheave pin with a first end that with a shoulder portion, a second end with a threaded portion, and a support section between the first and second ends;

inserting the second end of the sheave pin into the bearing assembly and securing a fastener to the second end of the sheave pin;

adjusting the position of the sheave pin relative to the bearing assembly by causing the shoulder portion to bear against the bearing assembly until the support section is fully seated;

positioning the bearing assembly within the central bore;

providing a first side section and a second side section; and securing the first and second side section to the sheave pin;

wherein the act of positioning the bearing assembly within the central bore comprises positioning at least one ring in at least one indentation in an inner surface of the central bore and positioning the bearing assembly adjacent to the at least one ring.

8. The method of claim 7, wherein the act of positioning the bearing assembly within the central bore comprises heating the sheave and positioning the bearing assembly within the heated sheave.

9. The method of claim 7, wherein the act of securing the first and second side sections comprises:

providing two fasteners;

securing one of the two fasteners to a portion of the first end that extends out of an opening in the side of the first side section; and securing the other of the two fasteners to a portion of the second end that extends out of an opening in the side of the second side section.

10. The method of claim 7, further comprising:

securing the first and second side sections to one another at locations radially outside of the location of the sheave.

11. The method of claim 7, further comprising:

lubricating the bearing assembly by delivering lubricant through a port located at the first end of the sheave pin, the port being in fluid communication with a lumen that extends at least partially through the sheave pin.

* * * * *